US007553144B2

(12) United States Patent
Okada et al.

(10) Patent No.: US 7,553,144 B2
(45) Date of Patent: Jun. 30, 2009

(54) GAS COMPRESSOR HAVING A PAIR OF HOUSING HEADS

(75) Inventors: Hiroshi Okada, Kariya (JP); Eitarou Tanaka, Nagoya (JP)

(73) Assignee: DENSO CORPORATION, Kariya (JP)

( * ) Notice: Subject to any disclaimer, the term of this patent is extended or adjusted under 35 U.S.C. 154(b) by 0 days.

(21) Appl. No.: 11/785,616

(22) Filed: Apr. 19, 2007

(65) Prior Publication Data

US 2007/0258841 A1 Nov. 8, 2007

(30) Foreign Application Priority Data

May 8, 2006 (JP) ..... 2006-129216

(51) Int. Cl.
*F01C 1/16* (2006.01)
*F01C 1/24* (2006.01)
*F03C 2/00* (2006.01)

(52) U.S. Cl. ..... 418/201.1; 418/132; 418/206.1

(58) Field of Classification Search ..... 418/131, 418/132, 191, 201.1, 201.3, 206.1
See application file for complete search history.

(56) References Cited

U.S. PATENT DOCUMENTS 2,705,922 A * 4/1955 Rathman ..... 418/201.1
4,119,392 A 10/1978 Breckheimer
4,917,583 A 4/1990 Frings et al.
5,527,168 A * 6/1996 Juday ..... 418/201.1
5,662,463 A * 9/1997 Mirzoev et al. ..... 418/201.1
6,354,823 B1 * 3/2002 Becher et al. ..... 418/201.1
6,663,366 B2 * 12/2003 Okada et al. ..... 418/201.1
2005/0013521 A1 1/2005 Yoshimura et al.
2006/0165335 A1 7/2006 Yoshimura et al.

FOREIGN PATENT DOCUMENTS

DE 3706588 * 8/1988 ..... 417/362
JP U-62-43191 3/1987
JP A-5-98903 4/1993
JP A-2003-139079 5/2003
JP A-2005-220785 8/2005

* cited by examiner

*Primary Examiner*—Theresa Trieu
(74) *Attorney, Agent, or Firm*—Posz Law Group, PLC

(57) ABSTRACT

In a gas compressor, housing heads are disposed to define an internal space with a housing, and two rotors housed in the internal space are rotatable to form in the internal space a compression chamber. The housing has an inner wall surface opposed to at least outer peripheral surfaces of the two rotors, and the housing heads are provided in correspondence to the respective rotors. One end portion of a rotary shaft of each rotor is supported by the housing, and other end portion of the rotary shaft of each rotor is supported by the housing heads. The housing heads have a first outer peripheral portion corresponding to the inner wall surface of the housing, and a second outer peripheral portion larger than the first outer peripheral portion. Furthermore, the first outer peripheral portion of the housing heads is fitted onto the inner wall surface of the housing.

19 Claims, 3 Drawing Sheets

GAS COMPRESSOR HAVING A PAIR OF HOUSING HEADS

CROSS REFERENCE TO RELATED APPLICATION

This application is based on Japanese Patent Application No. 2006-129216 filed on May 8, 2006, the contents of which are incorporated herein by reference in its entirety.

BACKGROUND OF THE INVENTION

1. Field of the Invention

The present invention relates to a gas compressor that rotates two rotors to suck, compress, and discharge gas.

2. Description of the Related Art

There has been conventionally known a gas compressor having two rotary rotors housed in a housing (e.g., JP-A-2005-220785). In this gas compressor, one end of the rotary shaft of each of the rotors is supported by a bearing hole of one housing head and the other end thereof is supported by a bearing hole of the housing.

To increase the discharge pressure of the gas compressor to high pressure, it is necessary to reduce a clearance between the rotors and the housing and to improve compression efficiency. In particular, in a gas compressor that does not use oil for improving seal performance between the rotors and the housing, it is greatly necessary to decrease the clearance. For this reason, the relative position of the housing to the housing head is usually determined by the use of positioning pins to improve the coaxial degree to which the bearing hole of the housing is coaxial with the bearing hole of the housing head, thereby the clearance between the rotors and the housing is decreased.

However, in the foregoing compressor, the accuracies with which pin holes are formed in the housing head and the housing are added to the accuracy of the coaxial degree to which the housing head is coaxial with the housing. Thus, the accuracy with which the housing head is coaxial with the housing deteriorates. Further, because bearing holes corresponding to the rotary shafts of the two rotors are formed in one housing head, the accuracies with which the respective bearing holes are formed are effected to the coaxial degree of the two bearing holes formed in the housing head. Thus, this presents a problem that the clearance between the rotors and the housing becomes large.

Moreover, because the pin holes need to be formed in the housing and the housing head with high accuracy, there is presented a problem that manufacturing cost increases. Further, when the housing head is positioned with respect to the housing by the use of a positioning pin, it takes much time to combine the housing head with the housing. This presents a problem that steps required to combine the housing head with the housing increase.

SUMMARY OF THE INVENTION

In view of the foregoing problems, it is an object of the present invention to provide a gas compressor capable of improving an accuracy with which housing heads are combined with a housing.

Further, it is another object of the present invention to reduce steps required to combine the housing heads with the housing.

According to an aspect of the present invention, a gas compressor includes a housing having a suction port and a discharge port, housing heads disposed to define an internal space with the housing, and two rotors housed in the internal space. The two rotors are rotatable around their rotary axes to form in the internal space a compression chamber in which gas sucked from the suction port is compressed, thereby discharging the compressed gas from the discharge port. Furthermore, the housing has an inner wall surface opposed to at least outer peripheral surfaces of the two rotors, and the housing heads are provided in correspondence to the respective rotors and have inner wall surfaces at end portions, opposed to one-end portions of the respective rotors. One end portion of a rotary shaft of each rotor is supported by the housing, and other end portion of the rotary shaft of each rotor is supported by the housing heads. In addition, the housing heads have a first outer peripheral portion corresponding to the inner wall surface of the housing and a second outer peripheral portion larger than the first outer peripheral portion, and the first outer peripheral portion of the housing heads is constructed to be fitted onto the inner wall surface of the housing.

Because the first outer peripheral portion of the housing heads is constructed to be fitted onto the inner wall surface of the housing, the inner wall surface of the housing can be used as a positioning hole for positioning the housing heads with respect to the housing. Thus, accuracies with which pin holes are formed in the housing and the housing heads are not added to the accuracies with which the housing heads are coaxial with housing. Hence, the coaxial degrees to which the housing heads are coaxial with the housing can be improved. As a result, the accuracies with which the housing heads are assembled with the housing can be improved and the clearances of the respective parts can be effectively reduced. Accordingly, it is possible to sufficiently reduce the quantity of leak of gas and to improve volume efficiency. In addition, it is possible to reduce steps required to combine the housing head with the housing.

For example, the housing heads corresponding to the respective rotors may have adjacent portions which overlap with each other in a direction parallel with a rotary axis of the rotors. Alternatively, the two rotors may be a male rotor and a female rotor, which have spiral projections formed on their outer peripheral surfaces to be engaged with each other.

Furthermore, the housing heads may be arranged without defining the compression chamber, or may be arranged to define the compression chamber.

BRIEF DESCRIPTION OF THE DRAWINGS

Additional objects and advantages of the present invention will be more readily apparent from the following detailed description of preferred embodiments when taken together with the accompanying drawings. In which.

DETAILED DESCRIPTION OF THE PREFERRED EMBODIMENTS

First Embodiment

Figure 2:
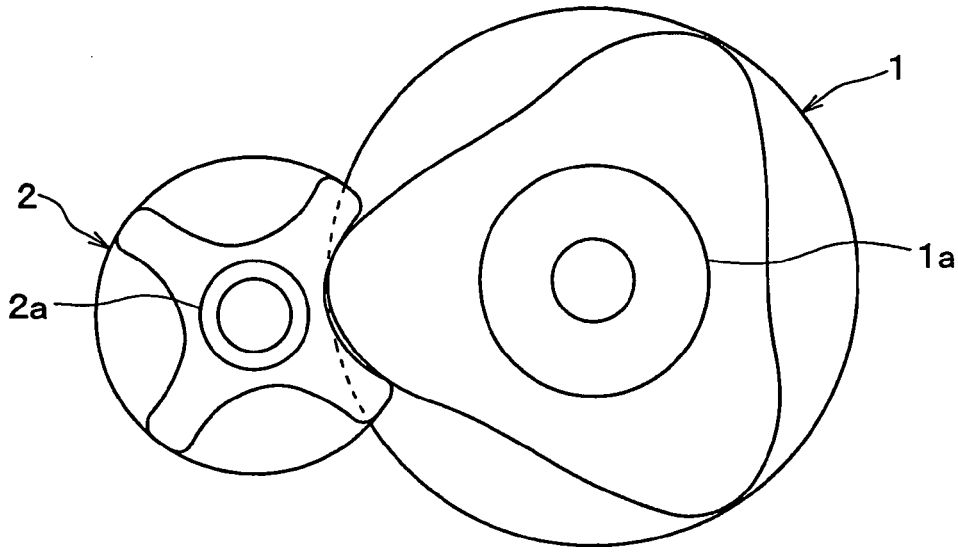
FIG. 2 is a side view showing a shape of an end surface in an axial direction of a rotor.
Figure 3:
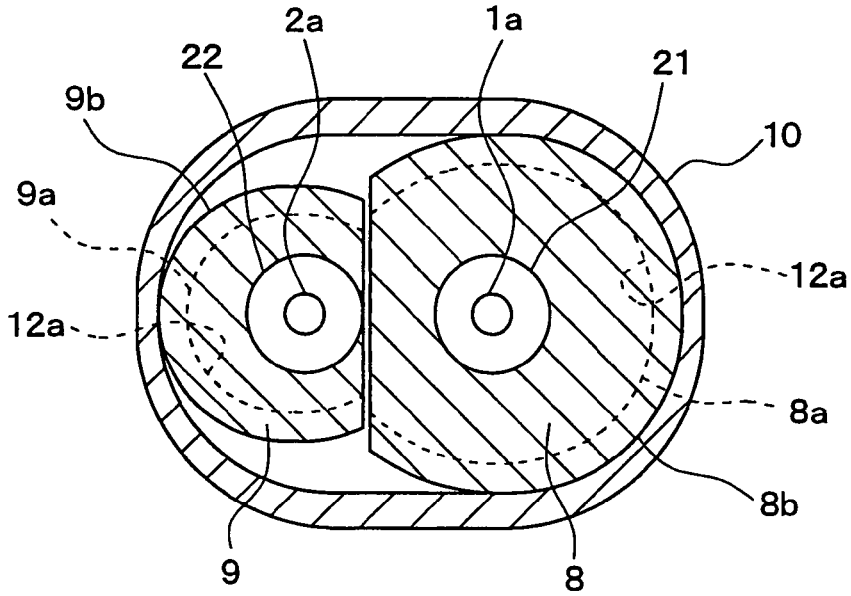
FIG. 3 is a cross-sectional view taken along the line III-III in FIG. 1.

A first embodiment of the present invention will be described with reference to FIG. 1 to FIG. 3. The first embodiment is an example in which the present invention is applied to a screw compressor and in which gas compressed by the screw compressor is air.

The screw compressor of this embodiment includes a pair of screw-shaped male rotor 1 and female rotor 2, a rotation transmission mechanism 3 for rotating and driving the rotors 1, 2 by the rotational force of a driving source, a casing 4 for housing the pair of rotors 1, 2 and the rotation transmission mechanism 3, an input shaft 5 for receiving the rotational force of the driving source, and the like. In FIG. 1, the pair of rotors 1, 2 are arranged side by side on the back side of the paper and on the front side thereof.

The male rotor 1 and the female rotor 2 are respectively formed in the shape of a male screw so as to engage with each other, such that the male screw is formed of a spiral projection on the outer peripheral surface of each rotor. As shown in FIG. 1, the male rotor 1 and the female rotor 2 are rotated and driven by the rotation transmission mechanism 3 supplied with a rotational force from the driving source of an electric motor 50 and the like. In this embodiment, the male rotor 1 is a driving side and the female rotor 2 is a driven side, and the male and female rotors 1, 2 rotate around the rotary shafts 1*a*, 2*a*, respectively. Thus, the motor 50 as the driving source is arranged on an extension in the axial direction of the male rotor 1.

The casing 4 includes a lubrication box 6, a rotor housing 7, housing heads 8, 9, and a head cover 10 which are arranged in this order from a position closer to the motor 50. The lubrication box 6, the rotor housing 7, and the head cover 10 are firmly assembled with each other with fastening means such as bolts or the like (not shown). The rotors 1, 2 and the rotation transmission mechanism 3 are housed in the casing 4 in a state in which they are separated from each other. The pair of rotors 1, 2 is housed in the cylindrical rotor housing 7 and the rotation transmission mechanism 3 is housed in the lubrication box 6. The rotor housing 7 is open on its one end side and the housing heads 8, 9 are arranged on the open side.

In the lubrication box 6, there is provided with a lubrication oil space 11 for receiving the rotation transmission mechanism 3 and a lubrication oil to be supplied to the rotation transmission mechanism 3. Oil having the same viscosity as an engine oil, for example, may be used as the lubrication oil. Gears constructing the rotation transmission mechanism 3 are sprayed with the lubrication oil in the lubrication oil space 11, thereby being lubricated.

The rotor housing 7 and the housing heads 8, 9 form an inner space and this inner space constructs a rotor chamber 12 in which the pair of rotors 1, 2 are housed. The rotor housing 7 has a suction port 7*a* for sucking air into the rotor chamber 12 and a discharge port 7*b* for discharging the air outside the rotor chamber 12. The suction port 7*a* is formed on a side of the housing head 8, 9 in an end portion of the rotor housing 7 in the axial direction, and the discharge port 7*b* is formed on a side of the lubrication box 6 in an end portion of the rotor housing 7 in the axial direction.

A small clearance is formed between the outer peripheral ends of the rotors 1, 2 and the inner wall 12*a* opposed to the outer peripheral surfaces of the rotors 1, 2, thereby a seal structure is constructed. A compression chamber 12*b* for compressing air sucked from the suction port 7*a* is formed between grooves formed on the outer peripheries of the rotors 1, 2 and the inner wall 12*a* of the rotor chamber 12.

In the lubrication box 6, an input shaft 5 for receiving a rotational force from the motor 50 is disposed. A first bearing 13 is provided in the lubrication box 6 on a side of the motor 50 side, and a second bearing 14 is provided in the lubrication box 6 on a side of the lubrication oil space 11. The input shaft 5 is supported by the lubrication box 6 via these bearings 13, 14. Moreover, a first oil seal 15 for preventing lubrication oil supplied to the first and second bearings 13, 14 from flowing outside the casing 4 is fitted in an insertion hole which is formed in the lubrication box 6 and in which the input shaft 5 is inserted.

As described above, the rotors 1, 2 are rotated and driven by the rotation transmission mechanism 3. The rotation transmission mechanism 3 is constructed so as to transmit the rotation of the input shaft 5 to the male rotor rotary shaft 1*a* and the female rotor rotary shaft 2*a* and to rotate the pair of rotors 1, 2 synchronously. The rotation transmission mechanism 3 includes a coupling 16, first and second gears 17, 18, and the like. The coupling 16 transmits the rotation of the input shaft 5 driven by the motor 50 to the male rotor rotary shaft 1*a* in a coaxial manner, the gears 17, 18 transmit the rotation transmitted from the coupling 16 to the male rotor rotary shaft 1*a* and the female rotor rotary shaft 2*a*. The first and second gears 17, 18 are timing gears for synchronously rotating the pair of rotor gears 1, 2.

The male rotor rotary shaft 1*a* and the female rotor rotary shaft 2*a* have their one ends rotatably supported by the rotor housing 7 via third and fourth bearings 19, 20 and have their other ends rotatably supported by the housing heads 8, 9 via fifth and sixth bearings 21, 22. In the housing 7, a bearing hole for arranging the third and fourth bearings 19, 20 is formed. The first housing head 8 is provided with a bearing hole for arranging the fifth bearing 21. Furthermore, the second housing head 9 is provided with a bearing hole for arranging the sixth bearing 22.

Insertion holes, which are formed in the rotor housing 7 and into which the rotary shafts 1*a*, 2*a* are inserted, have second and third oil seals 23, 24 fitted thereon. The oil seals 23, 24 are provided to prevent the lubrication oil supplied to the third and fourth bearings 19, 20 from leaking into the rotary chamber 12. Further, insertion holes, which are formed in the housing heads 8, 9 and into which the rotary shafts 1*a*, 2*a* are inserted, also have fourth and fifth oil seals 25, 26 fitted thereon. The oil seals 25, 26 are provided to prevent grease sealed in the fifth and sixth bearings 21, 22 from leaking into the rotary chamber 12.

Next, the structure of the housing heads 8, 9 will be described. FIG. 3 is a sectional view along the line III-III in FIG. 1 and shows the structure of the housing heads 8, 9. As shown in FIG. 3, the housing heads 8, 9 of this embodiment are divided into a first housing head 8 arranged on the end surface of the male rotor 1 and a second housing head 9 arranged on the end surface of the female rotor 2. The first housing head 8 is provided with the fifth bearing 21 for supporting the male rotor rotary shaft 1*a* and the second housing head 9 is provided with the sixth bearing 22 for supporting the female rotor rotary shaft 2*a*. The first and second housing heads 8, 9 are respectively formed in the shapes of disks whose diameters are larger than the diameters of the end surfaces of the rotors 1, 2 corresponding to them, and which have cut portions overlapping with each other.

Figure 1:
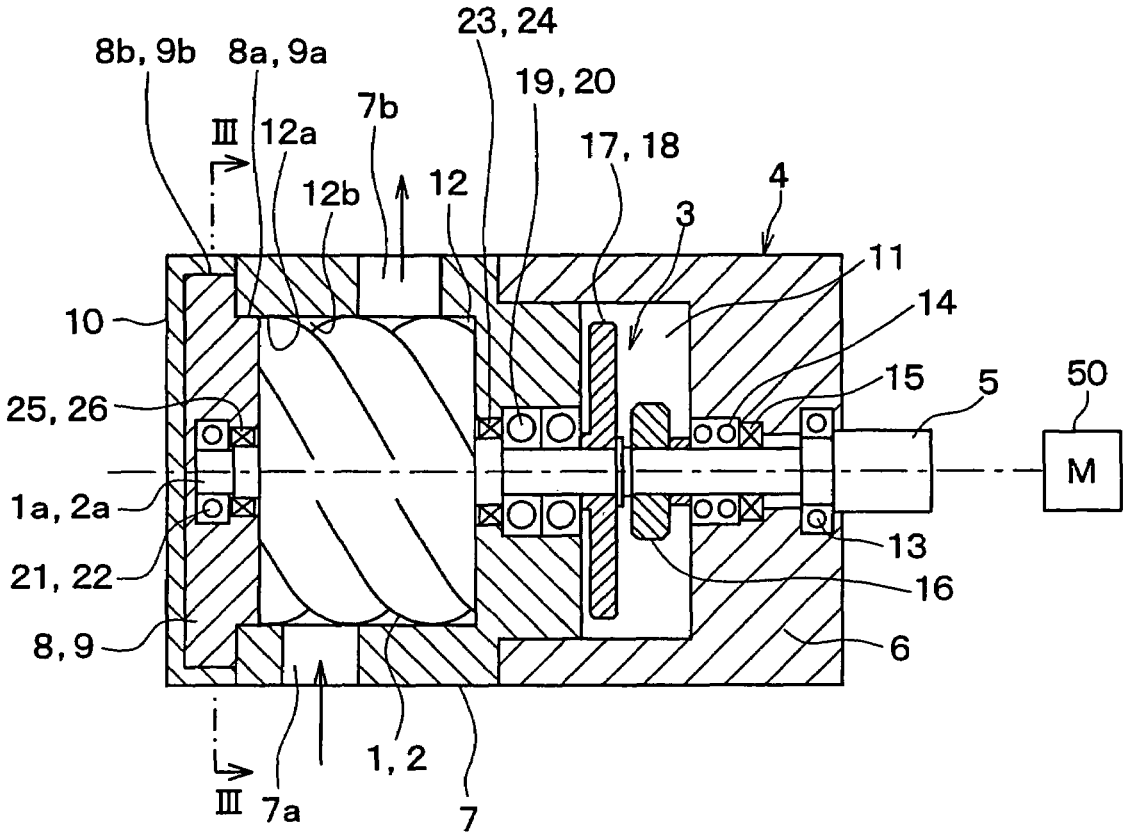
FIG. 1 is a cross-sectional view showing a screw compressor according to a first embodiment of the present invention.

As shown in FIG. 1, the housing heads 8, 9 are formed in stepped shapes and have first outer peripheral portions 8*a*, 9*a* and second outer peripheral portions 8*b*, 9*b*, respectively. The first outer peripheral portions 8*a*, 9*a* are different from each other in a distance from the center to the outer periphery. The second outer peripheral portions 8*b*, 9*b* also are different from each other in a distance from the center to the outer periphery. The first outer peripheral portions 8*a*, 9*a* are formed in shapes corresponding to the shape of the inner wall surface 12*a* of the rotor chamber 12. The second outer peripheral portions 8*b*, 9*b* are larger than the first outer peripheral portions 8*a*, 9*a*, respectively. Moreover, the inner wall surface 12*a* of the rotor chamber 12 of the rotor housing 7 is slightly longer than the rotors 1, 2. For this reason, the first outer peripheral portions 8*a*, 9*a* of the housing heads 8, 9 are formed in a nested construction in which they are inserted and fitted in the end portions of the inner wall surface 12*a* of the rotor chamber 12. The inner wall surface 12*a* of the rotor chamber 12 functions as a positioning hole for positioning the housing heads 8, 9 to the rotor housing 7.

A head cover 10 is disposed outside the housing heads 8, 9. The head cover 10 has a depressed portion in which the second outer peripheral portions 8*b*, 9*b* of the housing heads 8, 9 are fitted. The head cover 10 functions as a cover for covering the surfaces opposite to the rotors 1, 2 in the housing heads 8, 9. The housing heads 8, 9 are covered with the head cover 10, thereby being closed from the outside.

Next, the operation of the screw compressor of this embodiment will be described.

When the pair of rotors 1, 2 are synchronously rotated by the rotation transmission mechanism 3, air is sucked from the suction port 7*a* formed on the side of the housing heads 8, 9 in the rotor housing 7, into the compression chamber 12*b*. At this time, with the rotation of the pair of rotors 1, 2, the compression chamber 12*b* moves from the housing heads 8, 9 to the lubrication oil space 11 to decrease its volume. Thus, air in the compression chamber 12*b* is gradually compressed and pressurized and is moved to the lubrication oil space 11.

When the rotational angles of the pair of rotors 1, 2 reach specified angles, the compression chamber 12*b* reaches the discharge port 7*b* formed on the side of the lubrication oil space 11 in the rotor housing 7, thereby the compression chamber 12*b*, which has been tightly closed, is brought to a state opened at the discharge port 7*b*. Thus, the air compressed in the compression chamber 12*b* is discharged from the discharge port 7*b*.

According to the first embodiment, when the first outer peripheral portions 8*a*, 9*a* of the housing heads 8, 9 are inserted into the end portions of the rotor chamber 12 of the rotor housing 7 in which the rotors 1, 2 are housed, the housing heads 8, 9 can be assembled to the rotor housing 7. At this time, because the respective housing heads 8, 9 are fitted in the inner wall 12*a* of the rotor chamber 12, the positions of the respective housing heads 8, 9 to the housing 7 are determined. In this manner, because the inner wall 12*a* of the rotor chamber 12 is used as a positioning hole for positioning the housing heads 8, 9 to the rotor housing 7, the accuracies with which pin holes are formed in the rotor housing 7 and the housing heads 8, 9 are not added to the accuracy with which the housing heads 8, 9 are coaxial with the housing 7. Thus, this can improve the coaxial degree to which the housing heads 8, 9 are coaxial with the rotor housing 7.

Moreover, the housing heads 8, 9 are divided from each other and bearing holes corresponding to the two rotors 1, 2 are formed in the different housing heads 8, 9. Thus, the coaxial degree to which two bearing holes after combining the housing heads 8, 9 with the rotor housing 7 are coaxial with each other can be improved, thereby the clearance between the rotors 1, 2 and the inner wall 12*a* of the rotor chamber 12 can be decreased and hence compression efficiency can be improved.

In this embodiment, the housing heads 8, 9 are separated from each other, so gas in the rotor chamber 12 may leak outside from the clearance between the housing heads 8, 9. To prevent the gas from leaking outside, the head cover 10 is arranged to cover the housing heads 8, 9. Therefore, the rotor chamber 12 can be shut from the outside and hence the hermeticity of the rotor chamber 12 can be ensured.

Still further, the first outer peripheral portions 8*a*, 9*a* of the housing heads 8, 9 move along the inner wall 12*a* of the rotor chamber 12. Therefore, the housing heads 8, 9 can be positioned also in the axial direction. With this, it is easy to regulate the clearance of the end surfaces of the rotors 1, 2 and hence to reduce the number of steps required to assemble the housing heads 8, 9 to the rotor housing 7.

Still further, the inner wall 12*a* of the rotor chamber 12 is used as the positioning hole for positioning the housing heads 8, 9 to the rotor housing 7. Thus, this can eliminate the need for forming pin holes for positioning the rotor housing 7 and the housing heads 8, 9, and hence can reduce the cost required to form the rotor housing 7 and the housing heads 8, 9.

Second Embodiment

Next, a second embodiment of the present invention will be described with reference to FIGS. 4A and 4B. The same function portions as in the first embodiment are denoted by the same reference symbols and their descriptions will be omitted and only different portions will be described.

Figure 4A:
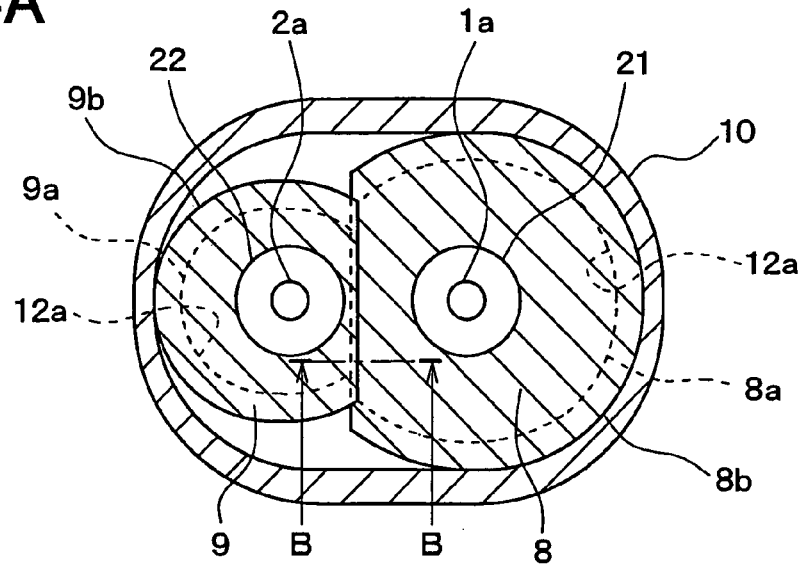
FIG. 4A is a cross-sectional view showing a construction of housing heads of a second embodiment of the present invention.
Figure 4B:
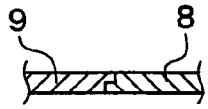
FIG. 4B is a cross-sectional view taken along the line IVB-IVB in FIG. 4A.

In the second embodiment, as shown in FIG. 4A, a first housing head 8 and a second housing head 9 are constructed in such a way that adjacent portions overlap each other when they are viewed from the axial direction of the rotors 1, 2. As shown in FIG. 4B, the first housing head 8 and the second housing head 9 are formed in stepped shapes projecting to opposite sides. Therefore, the adjacent portions of the first housing head 8 and the second housing head 9 are overlapped with each other in a direction parallel to an axial direction of the rotors 1, 2. For example, in this embodiment, the first housing head 8 and the second housing head 9 are provided with the stepped adjacent portions, which are engaged with each other to have approximately a uniform thickness at the overlapped portion.

As described above, the adjacent housing heads 8, 9 overlap each other in the axial direction of the rotors 1, 2, so the contact area between the housing heads 8, 9 can be increased and hence the clearance between the housing heads 8, 9 can be decreased. With this, it is possible to prevent the gas in the rotor chamber 12 from leaking outside from the clearance between the housing heads 8, 9 and hence to prevent the efficiency of the compressor from decreasing. Moreover, in the screw compressor using the screw rotors 1, 2, the pressure in the rotor chamber 12 is increased as compared with a Root's compressor, so the construction of this embodiment is especially effective.

Third Embodiment

Next, a third embodiment of the present invention will be described with reference to FIG. 5. The same function portions as in the first embodiment are denoted by the same reference symbols and their descriptions will be omitted and only different portions will be described.

Figure 5:
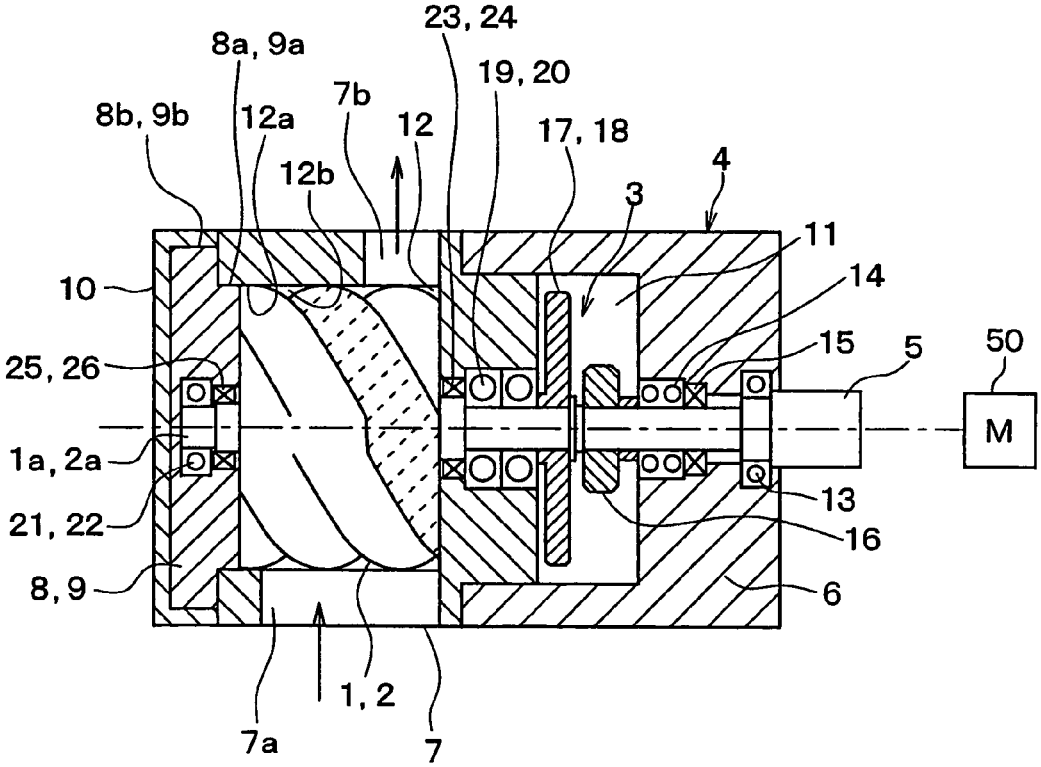
FIG. 5 is a cross-sectional view showing a screw compressor according to a third embodiment of the present invention.

FIG. 5 is a sectional view of a screw compressor of the third embodiment. As shown in FIG. 5, in the third embodiment, the suction port 7*a* is formed in a large size. That is, the suction port 7*a* is widely opened from a position close to the housing heads 8, 9 to a position close to the lubrication box 6, in the axial direction of the rotor housing 7. For this reason, of the groove formed in the outer peripheries of the rotors 1, 2, one end of a groove, the other end of which is positioned at the end surfaces of the housing heads 8, 9, communicates with the outside. Thus, a portion shown by the broken inclined lines in the rotors 1, 2 forms a compression chamber 12*b* just after suction, in FIG. 5.

According to the foregoing construction of the third embodiment, the end surfaces of the housing heads 8, 9 are not used as the surfaces constructing the compression chamber 12. Thus, it is possible to prevent the gas in the rotor chamber 12 from leaking outside from the clearance between the housing heads 8, 9. The construction of the third embodiment may be combined with the construction of the second embodiment. That is, the overlapped structure of the first and second housing heads 8, 9 described in the second embodiment may be used for the housing heads 8, 9 of the third embodiment.

Other Embodiments

Although the present invention has been fully described in connection with the preferred embodiments thereof with reference to the accompanying drawings, it is to be noted that various changes and modifications will become apparent to those skilled in the art.

For example, in the respective foregoing embodiments have been shown examples in which the present invention is typically applied to the screw compressor. However, the present invention can be applied also to a Root's compressor or the other type compressor.

Moreover, the respective embodiments are constructed so as to compress air by the compressor but may be constructed so as to compress other gas.

Such changes and modifications are to be understood as being within the scope of the present invention as defined by the appended claims.

What is claimed is:

1. A gas compressor comprising:

a housing having a suction port and a discharge port;

two separate, independent housing heads disposed to define an internal space with the housing; and two rotors that are housed in the internal space, wherein the two rotors are rotatable around their rotary axes to form in the internal space a compression chamber in which gas drawn from the suction port is compressed, the compressed gas is discharged from the discharge port by the rotors, the housing has an inner wall surface opposed to at least outer peripheral surfaces of the two rotors, each of the housing heads is located to correspond to a corresponding one of the rotors and has inner wall surfaces opposed to corresponding end portions of the corresponding one of the rotors, each rotor has a rotary shaft, which has a first end and a second end, wherein the second end is opposite to the first end, and the first end of each rotary shaft is supported by the housing, and the second end of each rotary shaft is supported by one of the housing heads, respectively, each housing head has a first outer peripheral portion corresponding to the inner wall surface of the housing and a second outer peripheral portion, which is larger than the first outer peripheral portion, in each housing head, the first outer peripheral portion is axially adjacent to the second outer peripheral portion, and the first outer peripheral portion of each housing head is constructed to be fitted onto the inner wall surface of the housing.

2. The gas compressor as in claim 1, wherein the housing heads corresponding to the respective rotors have adjacent portions that overlap with each other.

3. The gas compressor as in claim 1, wherein the two rotors are a male rotor and a female rotor, which have spiral projections formed on their outer peripheral surfaces to be engaged with each other.

4. The gas compressor as in claim 1, wherein the housing heads are arranged without defining the compression chamber.

5. The gas compressor as in claim 1, wherein the housing heads are arranged to define the compression chamber.

6. The gas compressor as in claim 1, further comprising a head cover located to cover the housing heads.

7. The gas compressor as in claim 1, wherein the suction port is provided in the housing at a side adjacent to the housing heads, and the discharge port is provided in the housing at a side opposite to the housing heads.

8. The gas compressor according to claim 1 wherein the first ends of the rotary shafts of the rotors protrude integrally from corresponding ends of the rotors and are rotatably supported by the housing by bearings; and the second ends of the rotary shafts protrude integrally from corresponding ends of the rotors and are rotatably supported by the respective housing heads with bearings.

9. The gas compressor according to claim 8, further comprising:

an electrical motor;

a casing located on a side of the one end portions of the rotary shafts, wherein the casing includes a lubrication box having therein lubrication oil;

a rotation transmission mechanism located in the casing; and an input shaft rotatably supported in the case to be rotated by the electrical motor, wherein the two rotors are configured to be rotated by rotation of the input shaft via the rotation transmission mechanism.

10. The gas compressor according to claim 1 wherein adjacent, facing surfaces of the housing heads engage with one another.

11. A gas compressor comprising:

a housing having a suction port and a discharge port;

two separate, independent, housing heads located at one end of the housing in a coplanar relationship to define an internal space with the housing; and two rotors that are housed in the internal space, wherein the two rotors are adapted to rotate about their respective axes to form a compression chamber in the internal space, wherein gas is drawn from the suction port and compressed, and compressed gas is discharged from the discharge port by the rotors, the housing has an inner wall surface opposed to outer peripheral surfaces of the two rotors, each of the housing heads is adjacent to the other of the housing heads and is located to correspond to a corresponding one of the rotors, each of the housing heads has an inner wall surface that faces an end portion of the corresponding one of the rotors, adjacent surfaces of the housing heads engage one another;

each rotor has a rotary shaft, which has a first end and a second end, the second end is opposite to the first end, the first end of each rotary shaft is supported by the housing, and the second end of each rotary shaft is supported by one of the housing heads, respectively, each of the housing heads has a first outer peripheral portion that corresponds to the inner wall surface of the housing and a second outer peripheral portion, which is larger than the first outer peripheral portion, in each housing head, the first outer peripheral portion is axially adjacent to the second outer peripheral portion, and at least a part of the first outer peripheral portion of each housing head is constructed to be fitted onto the inner wall surface of the housing.

12. The gas compressor according to claim 1, wherein the two rotors include a first rotor and a second rotor, the rotary axis of the first rotor is a first rotary axis, and the rotary axis of the second rotor is a second rotary axis, the housing heads include a first housing head and a second housing head, the first rotary axis intersects the first housing head, and the second rotary axis intersects the second housing head, the first outer peripheral portion of the first housing head is closer to the first rotor than the second outer peripheral portion of the first housing head, and the first outer peripheral portion of the second housing head is closer to the second rotor than the second outer peripheral portion of the second housing head.

13. The gas compressor according to claim 1, wherein the first outer peripheral portion of each housing head is located at a different position of the corresponding one of the rotary axes from the second outer peripheral portion of each housing head, and a step is formed between the first outer peripheral portion and the second outer peripheral portion in each housing head.

14. The gas compressor according to claim 1, wherein the rotors are housed within a rotor housing, which has an end surface, and a step surface is formed between the first outer peripheral portion and the second outer peripheral portion of each housing head, and the step surfaces of the housing heads engage the end surface of the rotor housing.

15. The gas compressor according to claim 1, wherein the housing heads are generally coplanar.

16. The gas compressor according to claim 11, wherein the two rotors include a first rotor and a second rotor, the rotary axis of the first rotor is a first rotary axis, and the rotary axis of the second rotor is a second rotary axis, the housing heads include a first housing head and a second housing head, the first rotary axis intersects the first housing head, and the second rotary axis intersects the second housing head, the first outer peripheral portion of the first housing head is closer to the first rotor than the second outer peripheral portion of the first housing head, and the first outer peripheral portion of the second housing head is closer to the second rotor than the second outer peripheral portion of the second housing head.

17. The gas compressor according to claim 11, wherein the first outer peripheral portion of each housing head is located at a different position of the corresponding one of the rotary axes from the second outer peripheral portion of each housing head, and a step is formed between the first outer peripheral portion and the second outer peripheral portion in each housing head.

18. The gas compressor according to claim 11, wherein the rotors are housed within a rotor housing, which has an end surface, and a step surface is formed between the first outer peripheral portion and the second outer peripheral portion of each housing head, and the step surfaces of the housing heads engage the end surface of the rotor housing.

19. The gas compressor according to claim 11, wherein the housing heads are generally coplanar.

* * * * *